US006789882B2

(12) United States Patent
Hiramatsu et al.

(10) Patent No.: US 6,789,882 B2
(45) Date of Patent: Sep. 14, 2004

(54) RECORDING APPARATUS

(75) Inventors: Soichi Hiramatsu, Tokyo (JP); Tomoyuki Nagase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/077,861

(22) Filed: Feb. 20, 2002

(65) Prior Publication Data

US 2002/0126180 A1 Sep. 12, 2002

(30) Foreign Application Priority Data

Feb. 23, 2001 (JP) ..... 2001-048673

(51) Int. Cl.[7] ..... B41J 2/17; B41J 2/175
(52) U.S. Cl. ..... 347/84; 347/85
(58) Field of Search ..... 347/84, 85, 50, 347/30, 86

(56) References Cited

U.S. PATENT DOCUMENTS 5,043,746 A * 8/1991 Abe ..... 347/85
6,168,262 B1 * 1/2001 Clark et al. ..... 347/50
6,422,693 B2 * 7/2002 Pawlowski et al. ..... 347/86
2002/0080207 A1 * 6/2002 Kanda et al. ..... 347/30

FOREIGN PATENT DOCUMENTS

JP 363264360 A * 11/1988 ..... B41J/3/04

* cited by examiner

*Primary Examiner*—K. Feggins
(74) *Attorney, Agent, or Firm*—Fitzpatrick, Cella, Harper & Scinto

(57) ABSTRACT

A recording apparatus for recording on a recording medium comprises a movable recording member facing a recording medium to record on said recording medium by serially moving with respect to the recording apparatus main body; a movement mechanism for serially moving said movable recording member; and plural flexible members for connecting the movable recording member and the recording apparatus main body, which are connected with the movable recording member from the sides opposite to each other with the movement path of the movable recording member between them, hence making it possible to reduce the influence on the positional precision of the movable recording member and the movement precision thereof as well, which is exerted by force given to the movable recording member by the flexible members.

33 Claims, 9 Drawing Sheets

RECORDING APPARATUS

BACKGROUND OF THE INVENTION

1. Field of the Invention

The present invention relates to a recording apparatus provided with a movable recording member for recording on a recording medium by moving serially with respect to the recording medium. More particularly, the invention relates to a recording apparatus provided with plural flexible members, such as electric cables, ink supply tubes, to connect a serially movable member (a single body of a carriage, a recording head mounted on such carriage, or a recording head and/or ink tank (or ink tanks) mounted on such carriage, for example) with the recording apparatus main body.

2. Related Background Art

Conventionally, there has been the so-called serial type recording apparatus that conveys a recording medium through the recording area where recording is performed by a recording head serving as recording means, thus recording as desired on the surface of the recording medium by use of the recording head, while moving a carriage in the widthwise direction of the recording head to be conveyed. Generally, for this serial type recording apparatus, there is a need for the transmission of electric signals from the control board of the apparatus main body to the recording head mounted on the carriage in order to enable it to operate recording, and the carriage and the control board are electrically connected by use of a cable. When plural recording heads are mounted on the carriage, plural electric cables are needed.

Also, for the serial type recording apparatus described above, there has been rapidly and widely used in recent years an ink jet recording apparatus that records on a recording medium or the like by the adhesion of ink droplets discharged from ink discharge ports provided for the recording med. The ink jet recording head mounted on the ink jet recording apparatus is often of the type that an ink tank is mounted together with the recording head to supply ink to the recording head. In recent years, however, in order to increase the amount of ink that can be supplied from one ink tank, the so-called tube supply type ink jet recording apparatus has been developed, in which an ink tank is mounted on a fixed location of installation on the apparatus main body, instead of mounting it on the carriage, and ink is supplied from such ink tank to the recording head on the carriage by way of a tube or the like. Then, if plural ink jet recording heads are mounted on the carriage, plural ink supply tubes are provided.

For the serial type recording apparatus, the electrical connection cable and ink supply tube are connected with the recording head, ink tank, or the like are once connected with and fixed to the carriage that moves, and then, connected with the recording head, ink tank, or the like, which has been mounted on the carriage or connected directly with the recording head or ink tank mounted on the carriage. Here, the cable or tube is formed by flexible material to make it deformable so as not to impede the movement of the carriage.

However, there are the problems given below for the conventional recording apparatus described above.

The cable or tube connected with the movable carriage or the recording head or ink tank mounted on the carriage has a length that enables the carriage to move within a designated range. Therefore, there occurs bending at least in the process of carriage movement. On the portion thus bent, there occurs the restoring force exerted by the bent that tends to return to be straight. This force is added to the carriage and a load (external force acting upon the carriage) is generated inevitably. Like this, the carriage may be given a load from the electrical connection cable or the tube in some cases.

Also, usually, for the cable or tube, there is a case where it is slightly slackened at least in the process of the carriage movement. Then, there may be encountered a problem that the cable or tube hangs down by its own weight as the time elapses. Particularly, the carriage moves to a designated location to be on standby at the time other than the execution of recording operation, but the cable and tube tend to be deformed by its own weight at that time if the cable and tube are kept for a long time in a state of being slackened. Further, there is a fear that such deformation may remain as the constant deformation. If the cable or ink tube hangs down like this, it is caused to be in contact with the other members in the recording apparatus. Then, there occurs a fear that the cable or tube itself or the member with which it is allowed to be in contact is damaged or that the ink tube is deformed to be twisted resulting in the unstable condition of ink distribution, thus the factors that may result in lowering the reliability of recording operation.

The problems described above are equally encountered in the case where the flexible member, which connects the carriage or a member mounted on the carriage with the apparatus main body, is only the cable or in the case where it is only the tube.

Further, the ink tube that supplies a large amount of ink should be given a careful attention as to any possible ink leakage, and then, a leakage prevention measure should be provided. However, if any ink leakage takes place so as to allow ink to contact with electric parts, such as the control board or electric cable, there is a fear that a serious trouble occurs such as to damage electrical parts. Therefore, it is necessary to structure the apparatus to protect the electric components, including the electrical connection cablel, as much as possible even in an emergency that ink leaks from the ink tube.

SUMMARY OF THE INVENTION

It is an object of the present invention to provide a recording apparatus having a plurality of flexible members, such as cables and tubes, for connecting a serially movable recording member (a single body of carriage, a recording head mounted on such carriage, or a recording head and/or ink tank (or ink tanks) mounted on such carriage, among some others, for example) and the recording apparatus main body, in which the influence that may be exerted by the flexible members on the movable member can be reduced with respect to the positional precision of the movable recording member and the movement precision thereof as well.

It is another object of the invention to provide a recording apparatus capable of preventing the flexible member, such as cable or tube, connected with the movable recording member of a serial type recording apparatus from being deformed by its own weight.

It is still another object of the invention to provide a recording apparatus capable of avoiding the contact of ink with electric components even if ink leakage should take place from the ink tube or the circumference thereof, which is connected with the movable recording member of a serial type recording apparatus.

It is a further object of the invention to provide the recording apparatus in which a first flexible member and a second flexible member for connecting a serially movable recording member with the recording apparatus main body are connected with the movable recording member, respectively, from the sides opposite to each other with the movement path of the movable member between them.

It is still a further object of the invention to provide the recording apparatus, which is a serially movable type recording apparatus, having little probability that ink is allowed to flow around to recording means and carriage on the side opposite to the tube connecting portion even if ink leakage should take place therein to make it possible to prevent liquid from being in contact with the cable connecting portion arranged on the opposite side.

It is still another object of the invention to provide the recording apparatus in which a first flexible member and a second flexible member for connecting the movable recording member of the serially movable type recording apparatus and the recording apparatus main body are connected with the movable recording member, respectively, from the sides opposite to each other with the movement path of the movable recording member between them, and the bending shape of the first flexible member and that of the second flexible member are linearly symmetrical to each other with the movement path of the movable recording member between them.

DETAILED DESCRIPTION OF THE PREFERRED EMBODIMENTS

Hereinafter, in conjunction with the accompanying drawings, the embodiments will be described in accordance with the present invention.

In this respect, the recording apparatus used for the description given below adopts mainly the mode that an ink jet recording head is mounted on a carriage, and the ink jet recording head and the control board on the apparatus main side are electrically connected by use of a flexible cable for use of electrical connection, and further, the ink jet recording head and an ink tank on the apparatus main body side are connected with an ink supply tube to make the ink supply possible. However, the present invention is not necessarily limited to this mode. The invention is applicable to the mode that not only an ink jet recording head is mounted on a carriage, but also, an ink tank is mounted thereon, and then, the memory holding tank information additionally provided for the ink tank and the control board on the apparatus main body side are connected by use of a cable. It is also applicable to the mode that ink is supplied form a large ink tank on the apparatus main body side to the ink tank that has been mounted on a carriage.

Further, it may be possible to adopt the mode that the cable or tube is connected directly with an ink jet recording head, the mode that the cable or tube is directly connected with an ink tank, or the mode that the cable or tube is once connected with a carriage, and after that, it is connected with an ink jet head or an ink tank through the pipe arranged in the carriage, respectively. In other words, the party on the side where the flexible member, such as cable or tube, is connected with the apparatus main body, may be an ink jet recording head or ink tank, which is a member mounted on a carriage, or a carriage itself.

In either case, the present invention is preferably and effectively applicable to a recording apparatus having two or more flexible members connected with the apparatus main body side for the carriage or the members mounted on the carriage (all of them referred to as the recording movable member).

Figure 1:
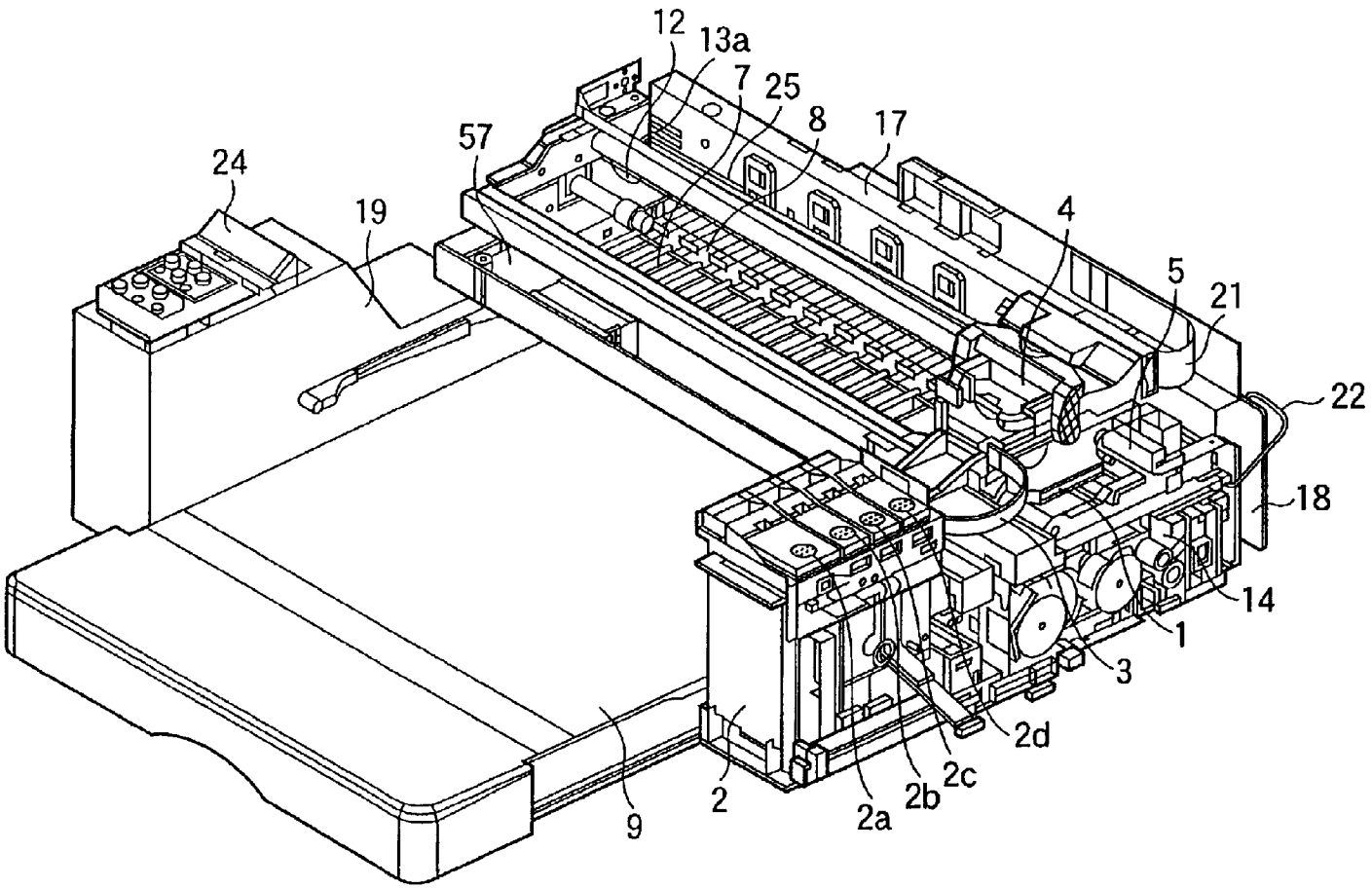
FIG. 1 is a perspective view that schematically shows the unit of mechanism of an ink jet recording apparatus of tube supply type in accordance with one embodiment of the present invention.
Figure 2:
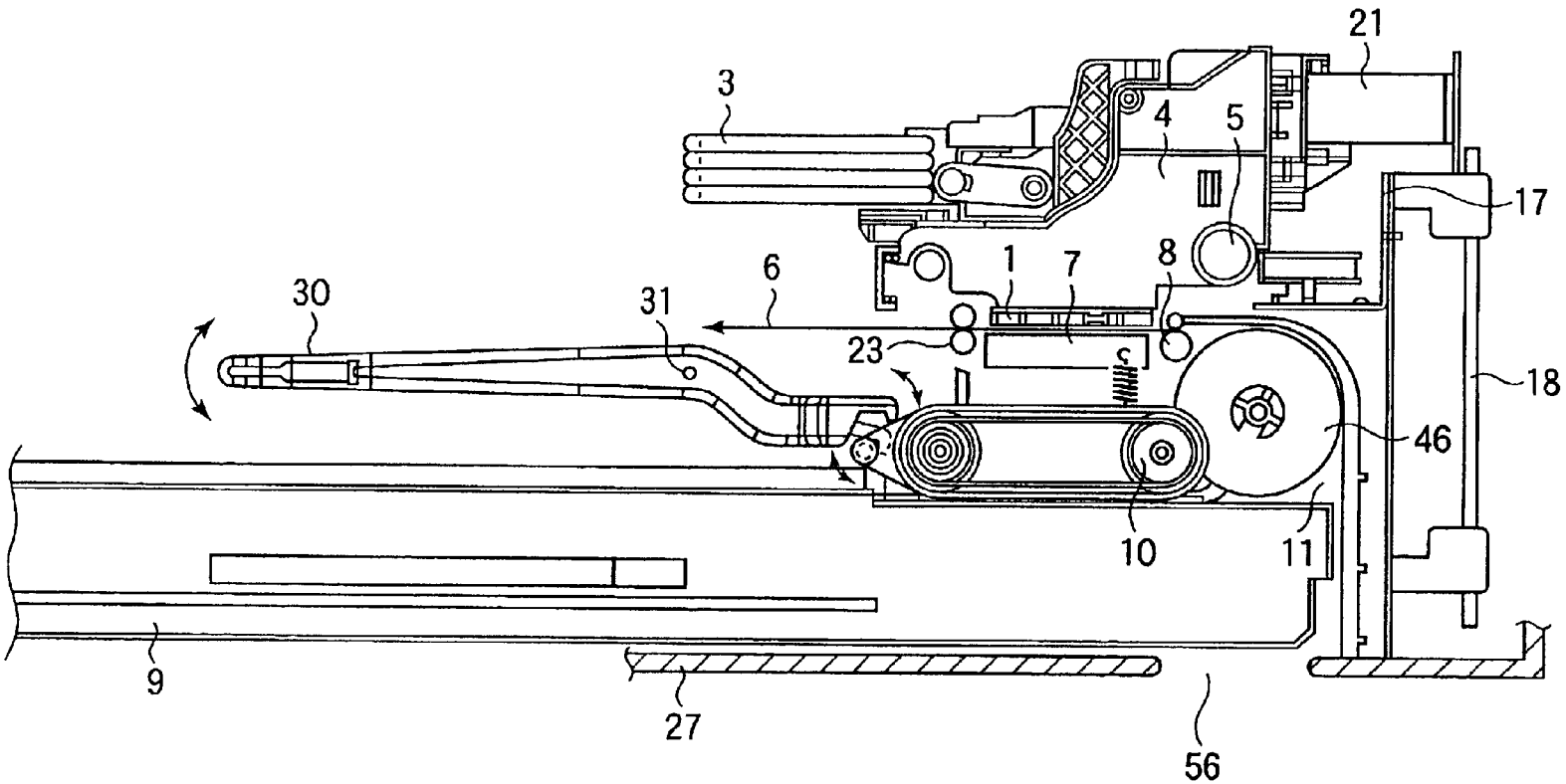
FIG. 2 is a cross-sectional view that schematically the unit of mechanism of the ink jet recording apparatus represented in FIG. 1.
Figure 3:
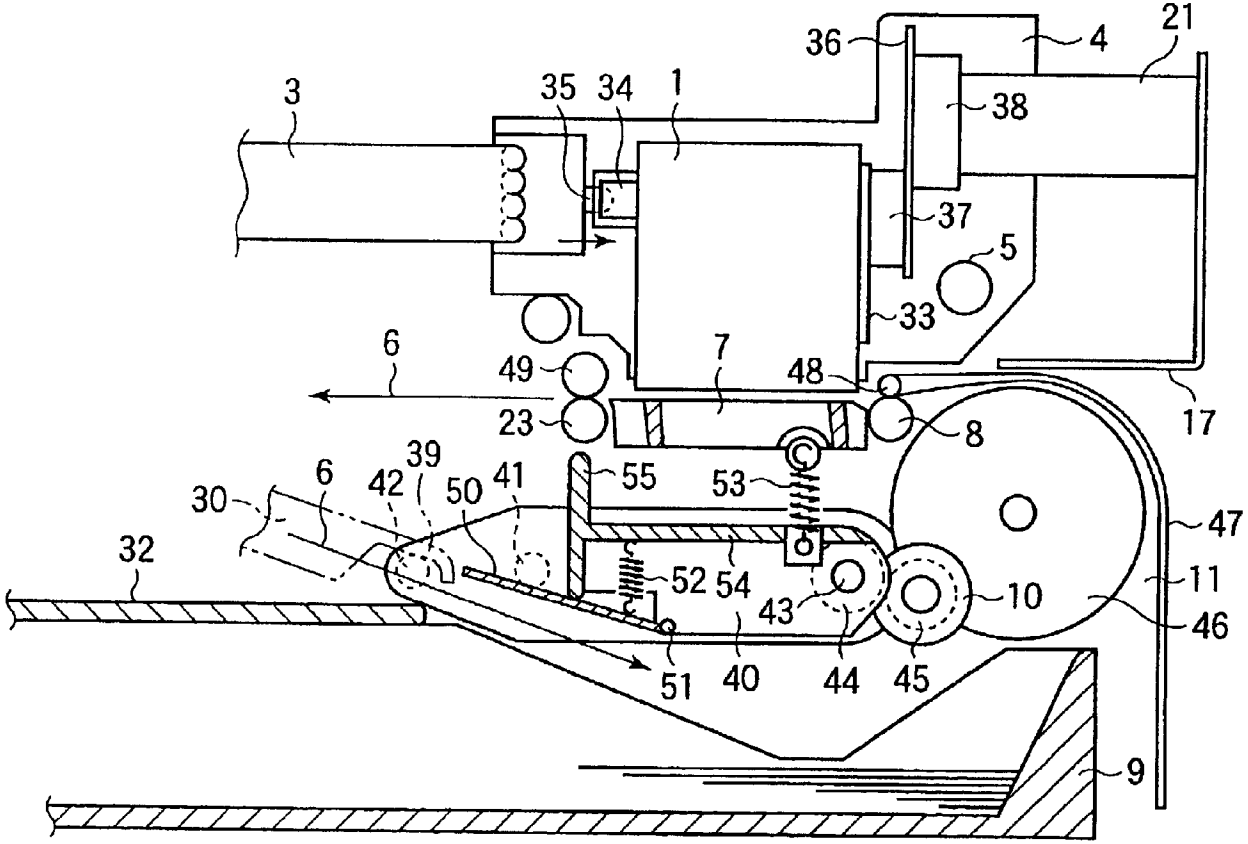
FIG. 3 is a cross-sectional view that schematically shows around the carriage of the unit of mechanism of the ink jet recording apparatus represented in FIG. 1.
Figure 4:
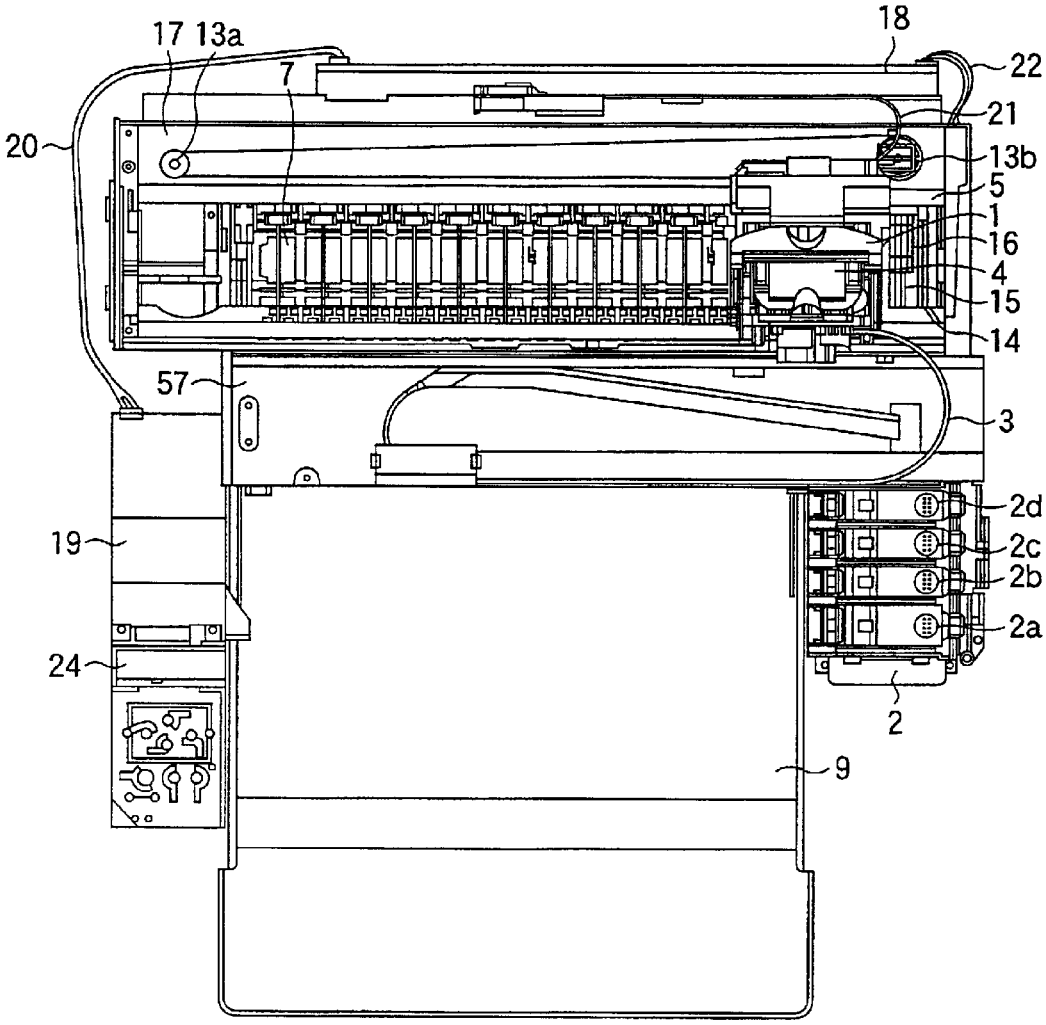
FIG. 4 is a plan view that schematically shows the unit of mechanism of the ink jet recording apparatus represented in FIG. 1.
Figure 5:
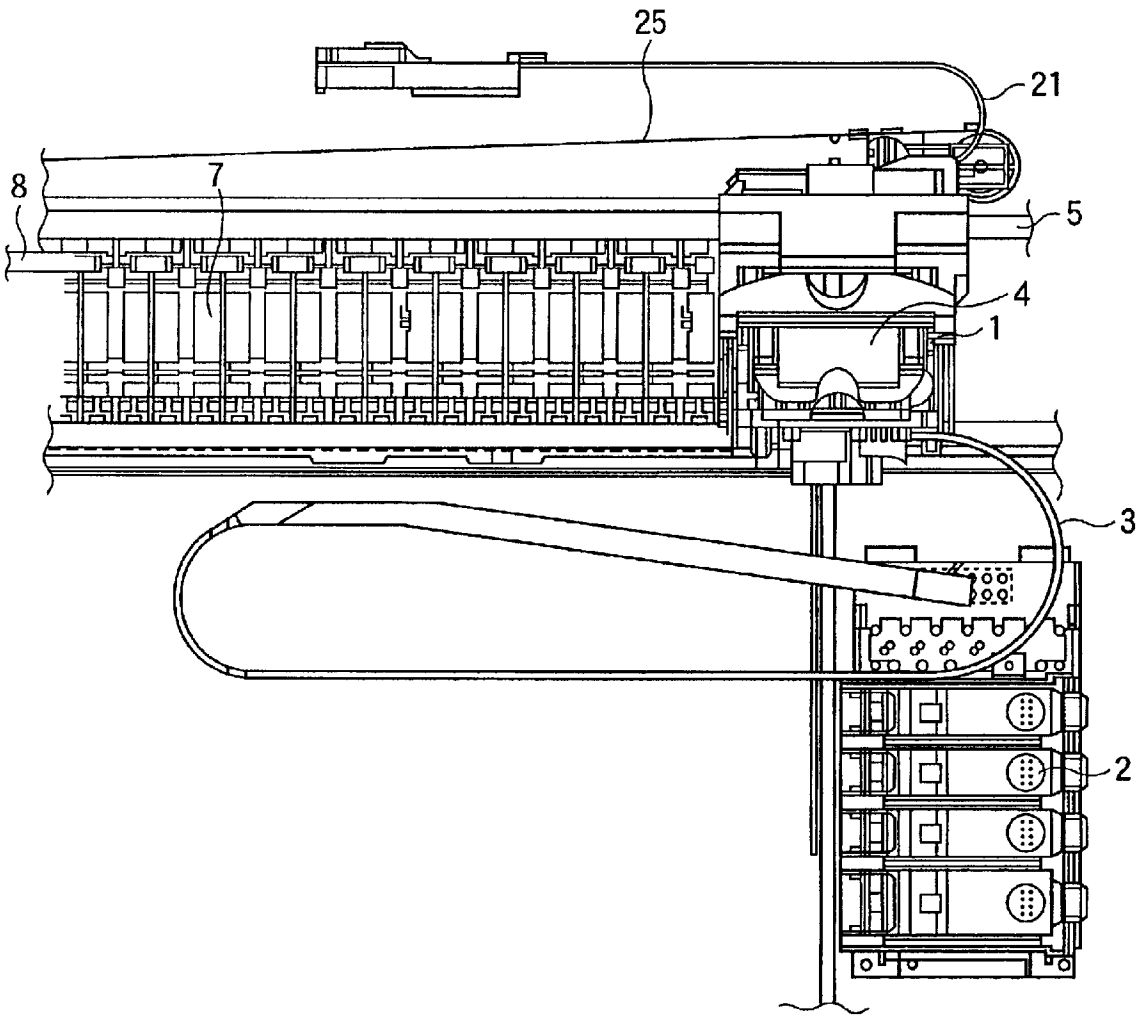
FIG. 5 is a plan view that schematically shows around the carriage of the unit of the mechanism of the ink jet recording apparatus represented in FIG. 1.

FIG. 1 is a perspective view that schematically shows the structure of the entire mechanism of an ink jet recording apparatus of tube supply type in accordance with one embodiment of the present invention. FIG. 2 and FIG. 3 are cross-sectional views that schematically illustrate the ink jet recording apparatus represented in FIG. 1, observed in the lateral direction. FIG. 3 is an enlargement of the vicinity of the carriage. FIG. 4 and FIG. 5 are plan views that illustrate the recording apparatus represented in FIG. 1. FIG. 5 is an enlargement of the vicinity of the carriage. Here, FIG. 1 and FIG. 5 are views that illustrate the structure of the unit of mechanism in a state of the case that forms the contour of the recording apparatus being removed.

Of those using ink jet recording method, this ink jet recording apparatus mounts a recording head 1 provided, particularly, with means for generating thermal energy as energy to be utilized for discharging ink (liquid), and makes changes of state of ink by means of the thermal energy thus generated. With the use of this method, it becomes possible to attain obtaining pixels in high density, and recorded images in high precision.

The recording head 1 has the mode in which ink is discharged to a recording medium 6, such as recording sheet, to be conveyed by conveying means. In other words, the recording head is mounted on the carriage 4 in a state of the surface (ink discharge surface) with discharge ports for discharging ink being directed downward. The carriage 4 is slidably installed along the guide shaft 5, which is fixed to the chassis 17, and extended on the conveying path of the recording medium 6 in the direction intersecting with the conveying direction. With the carriage 4, there is coupled a timing belt 25, which is tensioned around the carriage pulleys 13*a* and 13*b* to be able to circulate around them. To the carriage pulley 13*a*, a carriage motor 12 is connected, and with the rotational driving thereof, the carriage 4 reciprocates through the carriage pulley 13*a* and the timing belt 25.

With the recording head 1, are connected the recording head flexible cable 21 to transmit signals, driving electric force, or the like that selectively means for generating energy to discharge ink, and the ink tube 3 that supplies discharging ink to the recording head. These are connected with the recording head 1 from the sides having the recording head 1 between them. For the ink jet recording apparatus of the present embodiment, the ink tube 3 is connected from the front side where the main operation is performed for the recording apparatus with the panel operation unit (panel unit) 24 provided with the operational switches through which the user inputs various instructions, and the display portion that indicates the status of the apparatus, among some others. Then, the recording head flexible cable 21 is connected from the back face side.

In this case, the flexible cable 21 is connected with the recording head 1 through the carriage board 36 arranged for the back face of the carriage 4. In other words, the flexible cable 21 is connected with the back face side of the carriage board 36 through the flexible connector 38, and the recording head 1 is connected by the recording head electrical contacts 33 arranged for the back face side, which having abutted against the head connector 37 arranged for the front face side of the carriage board 36.

Also, the tube joint 35, which is arranged for the end portion of the ink tube 3, is inserted into the recording head ink joint portion 34 for the connection thereof, which is arranged on the font face side of the recording head 1.

The connection of the recording head 1 with the ink flow path, and the electrical connecting portion is made as given below. At first, the recording head 1 is installed on the designated position of the carriage so that the recording head electrical contacts 33 are pressured to the head connector 37 to make electrical connection. Then, the tube joint 35 is depressed into the recording head ink joint portion 34 in the direction indicated by an arrow in FIG. 3, thus connecting the ink flow path. A this juncture, since the connection parts of the electrically connecting portion and the ink flow path are arranged on the positions to face each other, the force added to the recording head 1 for depressing the tube joint 35 is directed to the same direction in which the recording head electrical contacts 33 is pressed to be in contact with the heat connector 37, and there is no possibility that any force is exerted by the force added to the recording head 1 for connecting the ink flow path so as to cause the pressurized connection of the electrical contacts to be apart for releasing or to cause any force thus exerted to displace the connected position, thus producing any unfavorable effect on the electrical connection at all.

The recording head flexible cable 21 extends on the back face side of the apparatus from the control board (control mechanism) 18 fixed to the chassis 17. The recording head flexible cable 21 is in the flat form, and plural wires are arranged almost in parallel in the widthwise direction. It is formed by flexible material and flexible in the thickness direction in particular. It may be possible to form the recording head flexible cable 21 by superposing plural flat cables.

Then, the recording head flexible cable 21 appears to the front face of the chassis 17 through the chassis 17 on the control board 18 side. It is fixed in such a posture that its width is directed almost in the vertical direction in the middle portion in the moving direction of the carriage 4. Then, from that portion, the recording head flexible cable 21 extends to the carriage 4 along the wall of the chassis 17 toward the right end side, while maintaining substantially the posture that the width is directed almost in the vertical direction, when the carriage 4 is on the standby position on the right end as shown in FIG. 5, and bent as if drawing a convex ark toward the right end side near the position facing the carriage 4. At this juncture, the recording head flexible cable 21 is held comparatively stably due to the certain rigidity that the cable has, and the creation of the bending portion described above as well. In other words, the recording head flexible cable 21 has rigidity, and also, the restoring force exerted on the bending portion is added to the recording head flexible cable 21 in the direction in which it is pulled. As a result, it extends stably and straightly along the front face of the chassis 17, and near the bending portion, the restoring force exerted thereon presses it toward the front face of the chassis 17. With the friction force generated thereby, it is held stably. Also, with the creation of the bending portion, the recording head flexible cable 21 is partly inclined from the direction in which the width thereof is directed toward the vertical direction, thus suppressing the twisting thereof, too.

The ink tube 3 extends from the ink tank portion 2 arranged at the right end of the recording apparatus in the front part of the moving path of the carriage 4. For the ink tank portion 2, four ink tanks (liquid tanks) 2*a*, 2*b*, 2*c*, and 2*d* are installed individually and exchangeably, each having different color, respectively.

Although not shown in detail, the recording head 1 is also structured with four potions each for discharging ink of different color, respectively. Corresponding thereto, the ink tube 3 is structured with four tubes each distributing different color of ink, respectively. Then, from each of the ink tanks 2*a*, 2*b*, 2*c*, and 2*d*, ink is supplied to the respective structural portion of the recording head 1 correspondingly.

The ink tube 3 is formed by the flat type four-strand tubes, in which four tubes are arranged in one line and coupled together. Here, flexible material is used to make the tube flexible in the widthwise direction in particular. The ink tube 3 runs from the ink tank 2 above the ink-tube supporting stand 57. The ink-tube supporting stand 57 extends almost over the length of the movement path of the carriage 4 on the front part side, and on the front edge thereof, the wall that protrudes upward is formed. On this ink-tube supporting stand 57, the ink tube 3 extends toward the left side at first, and in the middle portion of the movement direction of the carriage 4, it is fixed in such a posture that the width thereof is directed substantially perpendicular. Then, from that portion, the ink tube 3 extends toward the right end side along the front wall of the ink-tube supporting stand 57, while keeping the widthwise direction almost perpendicularly, when the carriage 4 is on the standby in the right end position as shown in FIG. 5, and extends to the recording head 1 with a curve formed as if drawing a convex ark toward the right end side near the position that faces the recording head 1. At this juncture, the ink tube 3 has certain rigidity, and with the bending portion described above together with this rigidity, it is stably held in the same way as the recording head flexible cable 21. The twisting thereof is also suppressed.

On the position at the right end of the movement path of the carriage 4, there is arranged the recovery device 14 that performs recovery operation to keep the ink discharge of the recording head 1 in good condition. The recovery device 14 is provided a cap 15 for covering the ink discharge ports of the recording head 1; a wiper 16 for wiping the ink discharge surface of the recording head 1; and a suction pump (not shown) for sucking ink from the ink discharge nozzles of the recording head 1, among some others. As shown in FIG. 4, when recording operation is at rest, the carriage 4 is held at the standby position on the right end where the recording head 1 is arranged to face the recovery device 14.

Next, the description will be made of the structure of conveying means that conveys a recording medium 6 through the recording area where the recording head 1 performs recording. The recording medium 6 used usually for recording is set in a cassette 9. The cassette 9 is detachably installed near the lower end of the recording apparatus main body by being inserted or drawn out from the front side. The upper face of the cassette 9 is covered with a cassette cover 32, and when the sheet number of recording medium becomes smaller, it is possible to draw out the cassette 9 from the recording apparatus main body, and the recording medium can be replenished by opening the cassette cover 32.

On the upper face of the cassette 9, the opening of the cassette 9 is arranged to remain on the leading end side in the direction of insertion in a state of being covered with the cassette cover 32, and for the recording apparatus main body, a sheet feeding arm 40 is arranged in a position above this opening. The sheet feeding arm 40 is rotatively supported around the rotational fulcrum 41, and a sheet-feeding roller 10 is fixed rotatively on the end portion on the rear side thereof. The sheet-feeding roller 10 is driven to rotate by means of the sheet feeding driving shaft 43, which is connected with and driven by a driving source (not shown), through a first transmission gear 44 and a second transmission gear 45. Usually, the sheet feeding arm 40 rotates in the clockwise direction by its own weight as shown in FIG. 2 and FIG. 3, and the sheet-feeding roller 10 is arranged to abut upon the upper face of the recording medium 6 stacked in the cassette 9. For the sheet feeding arm 40, a sheet feeding arm spring 53 is fixed to bias it in the counterclockwise direction in FIG. 2 and FIG. 3. By means of the sheet feeding arm spring 53, the abutting force of the sheet-feeding roller 10 is adjusted so that the sheet-feeding roller 10 does not encroach thereon by exerting excessive abutting force on the recording medium 6 even when there is a change in the stacked amount of the recording medium 6. The sheet feeding arm spring 53 is arranged each almost on the same position on both ends of the sheet-feeding roller 10 in the sheet widthwise direction. Then, the structure is arranged so as to make the fluctuations smaller for the abutting force of the sheet-feeding roller 10 against the recording medium 6 in the sheet widthwise direction.

Diagonally above the back side of the sheet feeding arm 40, there is arranged a rotatively supported U-turn roller 46, and slightly away from this roller, a U-turn guide 47 is arranged to cover the outer circumference thereof. Then, a U-turn conveyance path 11 is formed between them. Here, the sheet feeding roller 10 and U-turn roller 46 are divided in the axial direction so that each of the rollers is able to enter between the counter-parties, respectively, and the sheet feeding arm 40 is made rotational until it becomes almost horizontal where each of them is in the overlapping condition as shown in FIG. 2 and FIG. 3, observed in the lateral direction. As a result, the cassette 9 can be inserted deep into the position where the cassette 9 covers the lower part of the U-turn roller 46 without being impeded by the sheet feeding arm 40.

For the exit of the U-turn conveyance path 11, the conveying roller 8 fixed to the chassis 17 is provided, which is driven to rotate by a feed motor (not shown), and the pinch roller 48, which is rotatively supported, is arranged to face it. In front of the conveying roller 8, where is fixed to the chassis 17, the platen 7 that supports a recording medium positioned to face the ink discharge surface of the recording head 1. Then, in front thereof, there are arranged the sheet-expelling roller 23 that rotates by means of driving mechanism (not shown), and the rotatively supported sheet-expelling spur 49 (rotational member used for expelling a recording medium) provided to face it.

Thus, the recording apparatus of the present embodiment expels the recording medium 6 forwardly after recording by use of the sheet-expelling roller 23. Here, the structure is arranged to stack the expelled medium on the cassette cover 32 and the expelled sheet stack lever 50 arranged on the rear side thereof. The expelled sheet stack lever 50 is supported rotatively around the rotational fulcrum 51 arranged on the rear end portion, and biased by a stack lever spring 52 in the clockwise direction shown in FIG. 3. In this manner, it usually keeps an inclined posture. The biasing force exerted by the stack lever spring 52 is weak enough to keep balance in a state of stacking the recording mediums 6 in a designated number. If the recording mediums 6 are stacked more than the designated number, the stack lever rotates in the counterclockwise direction until the front end in the height of upper face of the cassette cover 32.

For the recording apparatus of the present embodiment, the platen 7 is positioned above the sheet-feeding arm 40, and the sheet-feeding arm 40 has an area almost equal to or more than the recording area on the platen 7. Also, a flat ceiling portion 54 is arranged to cover the lower part of the platen 7. With this flat ceiling portion 54, the ink droplets, which should erroneously be discharged onto the platen 7 and drop off from the opening of the platen 7, are received to prevent the recording medium 6 or the like in the cassette 9 from being stained by ink. Also, at the same time, ink mist, dust particles, or the like is prevented from dropping off to the recording medium 6 in the cassette 9. Also, for the front edge of the falt ceiling portion 54, the stack wall 55, which extrudes upward, is provided to partition the expelled sheet stacking portion and the apparatus interior for the prevention of dust particles or the like from entering the apparatus interior.

In front of the sheet-feeding arm 40 and in the vicinity of the left end of the recording apparatus, a rotatively supported manual lever 30 is arranged, which rotates around the rotational fulcrum 31. For the front edge of the sheet-feeding arm 40, a sheet-feeding arm releasing extrusion 42 is arranged, upon which abuts the manual lever operational portion 39, which is arranged on the rear end of the manual lever 30, when the manual lever 30 rotates in the clockwise direction in FIG. 2 and FIG. 3. Here, with the front end of the manual lever 30 being lifted upward to rotate in the clockwise direction in FIG. 2 and FIG. 3, the manual lever operational portion 39 is enabled to abut upon the sheet-feeding arm releasing extrusion 42 to press it downward for rotating the sheet-feeding arm 40 in the counterclockwise direction. In this way, the sheet-feeding roller 10 is allowed to part from the upper surface of the recording medium 6 stacked on the cassette 9. In this state, any special recording medium, such a recording medium of different size from the one currently stacked in the cassette 9 can be inserted along the upper surface of the cassette cover 32 to be set between the recording medium 6 stacked on the cassette 9 and the sheet-feeding roller 10 for use of the next recording. When such a special medium is set by manual insertion, the recording medium thus inserted abuts against the lower face of the expelled sheet stack lever 50. Then, it is guided into the cassette 9. In other words, the expelled sheet stack lever 50 functions as such guide, too.

The control board 18 having control means for controlling the operations of the aforesaid recording head, conveying means, and the like is arranged on the back face of the chassis 17 described above. The control board 18 has the interface that inputs recording signals; the MPU that executes arithmetic operation in accordance with control programs; the ROM that stores the control programs executed by the MPU; and the DRAM that keeps various data, among some others, installed thereon.

Such element as MPU thus installed on the control board 18, the recording head 1, recovery means 14, the carriage motor 12, and the electric supply source 19 that supplies electric power to be consumed by the driving source of each roller of conveying means or the like are arranged in the vicinity of the left front end of the apparatus main body. Electric power from the electric supply source 19 is supplied to the control board 18, at first, by way of an electric supply source cable 20. The control board 18 is electrically connected with the recording head 1 through the recording head flexible cable 21; with the recovery device 14 through the recovery device driving cable 22; and with other motors or the like through cables (not shown), respectively. Through these cables, driving electric power, driving signals, and the like are transmitted. The aforesaid panel operation unit 24 is arranged on the upper surface of the case arranged for the electric supply source 19.

Figure 6:
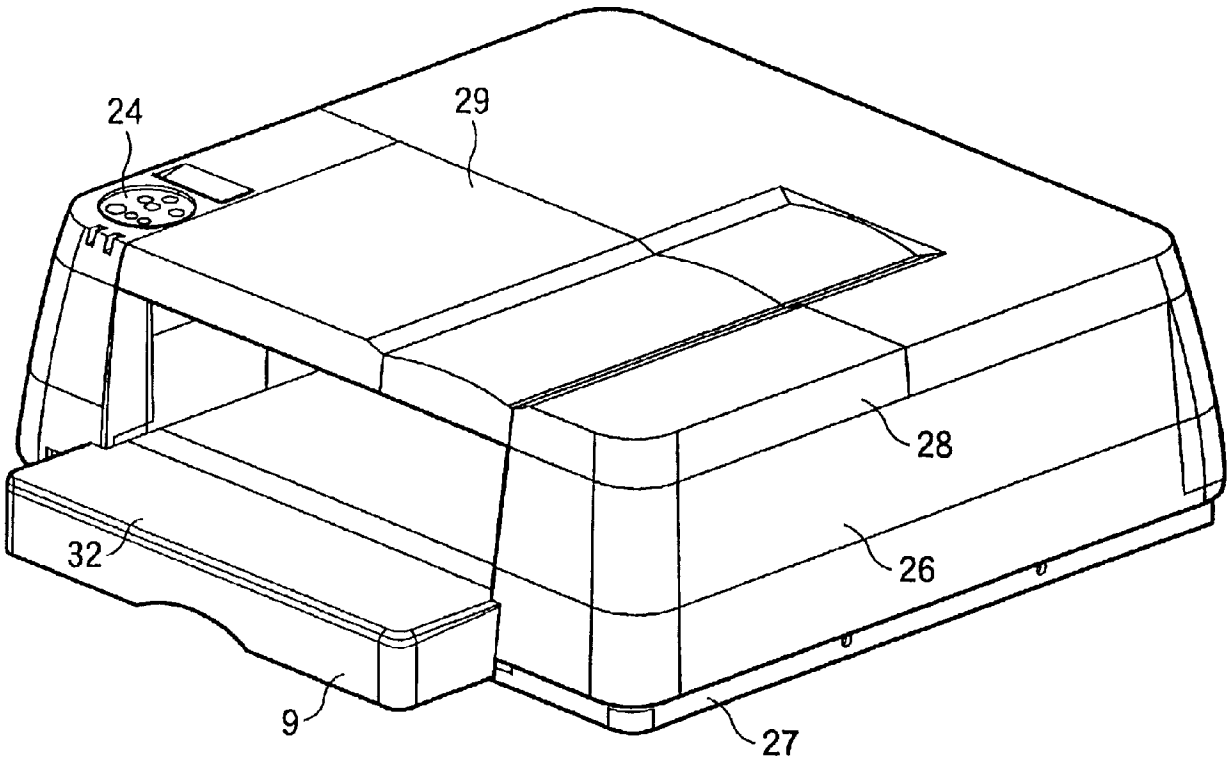
FIG. 6 is a perspective view that shows the outer appearance of the ink jet recording apparatus represented in FIG. 1.
Figure 7:
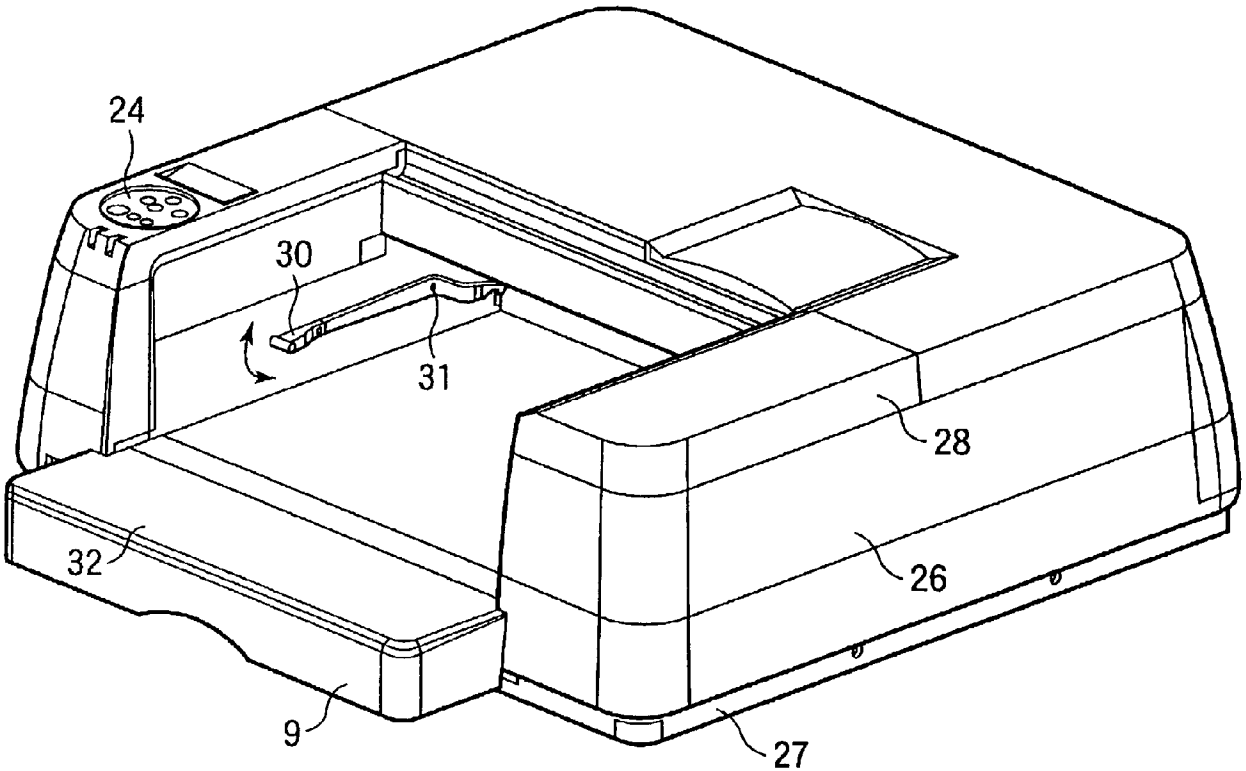
FIG. 7 is a perspective view that shows the outer appearance of the ink jet recording apparatus represented in FIG. 1 in a state of the sheet-expelling cover being open.

The unit of mechanism described with reference to FIG. 1 and FIG. 5 is incorporated in a case as shown in FIG. 6 and FIG. 7. FIG. 6 and FIG. 7 are perspective views that illustrate the outer appearance of the ink jet recording apparatus of the present embodiment. FIG. 6 shows the state of the usual use where the sheet-expelling cover 29 is closed. FIG. 7 shows the state where the sheet-expelling cover 29 is open to operate the manual sheet-feeding operation or the state where an expelled recording sheet is being drawn out.

The case is formed by the upper case 26 and the lower case 27, and the unit of mechanism is incorporated on the lower case 27, the upper part of which is covered by the upper case 26. Also, on the lower face of the lower case 27, there is provided as shown in FIG. 2, a jamming disposition opening 56 in a position near the lower part of the U-turn roller 46 for removing a recording medium 6 when the recording medium 6 is hooked or jammed on the way of conveyance. Near the left front end of the upper face of the upper case 26, an opening is arranged in a position where the operation switches and display section of the panel operation unit 24 are exposed, and it is made possible to confirm the operation of switches and indication thereof in a state of the upper cover 26 being installed. Also, near the right front end, an ink cover 28 is arranged to enable the upper part of ink tank unit 2 to be exposed so that each of the ink tank 2*a*, 2*b*, 2*c*, and 2*d* can be replaced when the ink cover 28 is open. For the ink jet recording apparatus of the present embodiment, the panel operation unit 24 is thus provided, and the ink cover 28 is arranged on the front side where the main operation is usually executed for the recording apparatus. Therefore, it is made easier to replace the ink tanks 2*a*, 2*b*, 2*c*, and 2*d* form the front side of the apparatus.

Also, the opening is arranged for the front face of the cover, and it is possible to insert the cassette 9 from this opening or draw out the recording medium expelled onto the cassette cover 32. Above the opening, the sheet-expelling cover 29 is arranged to be able to open it as shown in FIG. 7. When the sheet-expelling cover 29 is open, the portions on the front side of the sheet-expelling roller 23 can be exposed. Therefore, even in a case where recording should be made on a recording medium having a short length, it is easier to draw out such recording medium when expelled. Also, the aforesaid manual inserting lever 30 is exposed in a state of the sheet-expelling cover 29 being open, thus making the operation easer. In other words, when a recording medium is set by manual insertion, it becomes easier to execute such setting operation with the sheet-expelling cover 29 being open.

Figure 8:
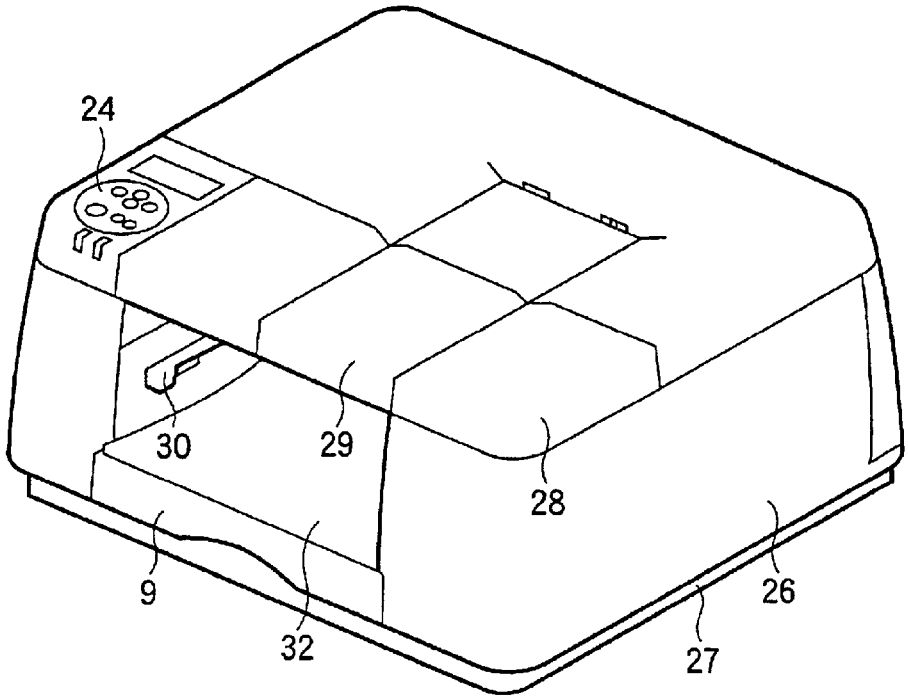
FIG. 8 is a perspective view that shows the outer appearance of an ink jet recording apparatus in accordance with another embodiment of the present invention.
Figure 9:
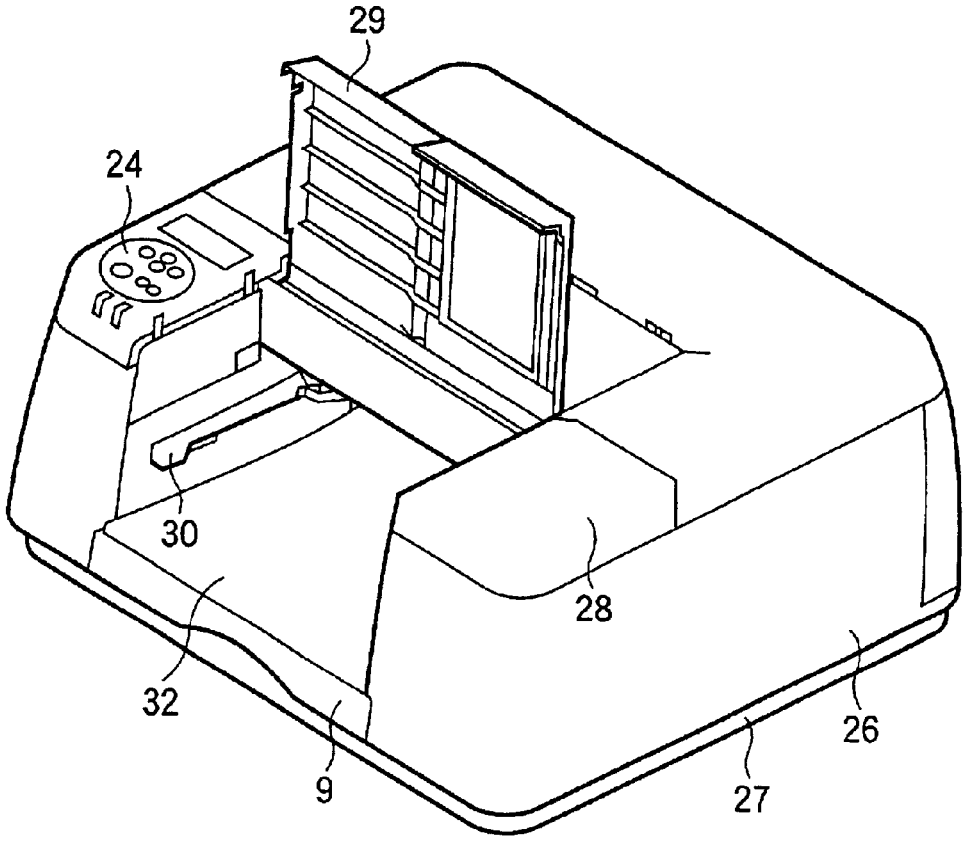
FIG. 9 is a perspective view that shows the outer appearance of the ink jet recording apparatus represented in FIG. 8 in a state of the sheet-expelling cover being open.

The ink jet recording apparatus shown in FIG. 6 and FIG. 7 is the one structured to be able to set a comparatively large size recording medium, such as an A3-sized recording medium, in the cassette 9, for example, and the cassette 9 protrudes from the front face of the case even when it is inserted in the depth direction completely. In contrast, the ink jet recording apparatus, the outer appearance of which is shown in FIG. 8 and FIG. 9, respectively, is the one that sets a comparatively small size recording medium, such as an A-4 or letter-sized recording medium, in the cassette 9.

For this ink jet recording apparatus, the cassette 9 is stored within in the front face line of the apparatus entire body without protruding from the case. The depth of the apparatus entire body is small, and the manual insertion lever 30 is installed in a position that can be observed without opening the sheet-expelling cover 29. However, a recording medium should be by the manual insertion, the operation becomes easier if the sheet-expelling cover 29 is open.

Next, the description will be made of the outline of the recording operation of the ink jet recording apparatus embodying the present invention.

The recording mediums 6 stacked in the cassette 9 are separated one by one for feeding when the sheet-feeding roller 10, which abuts upon the upper face thereof, is driven to rotate. The recording medium 6 thus fed is supplied to the conveying roller 8 through the U-turn conveyance path 11 around the rotatively driven U-turn roller 46. The conveying roller 8 is rotatively driven to lead the recording medium 6 thus supplied to the designated recording position on the platen 7.

When the recording medium 6 is led to the recording position, the carriage motor 12 is driven to enable the carriage 4 to move along the guide shaft 5 for scanning to determine the recording position in this direction of movement. At this juncture, the recording head 1 is driven to discharge ink droplets for the adhesion thereof on specific positions on the recording medium 6, thus recording images per scan.

Next, the recording medium 6 is conveyed in a specific amount corresponding to the recorded with of one scanning portion. After that, images of the next one scan portion are formed while the carriage 4 moves again along the guide shaft 5.

In this way, after recording is finished on the specific area of the recording medium 6, the sheet-expelling roller 23 is driven to rotate and expels the recording medium 6 onto the sheet-expelling stack lever 50 and the cassette cover 32.

For the ink jet recording apparatus embodying the present invention as described above, the ink tube 3, which is connected with the recording head 1 mounted on the carriage 4, is connected from the front side, and the recording head flexible cable 21 is connected from the rear side, respectively, from the sides opposite to each other with the movement path of the carriage 4 between them. Therefore, even if any ink leakage should occur from the ink tube 3, there is little possibility that ink flows to the opposite side of the carriage 4, hence making it possible to minimize the probability that electric contacts and other electric components, which are positioned on the side where the recording head flexible cable 21 is connected, are in contact with ink.

Also, the structure can be formed reasonably, in which the ink tube 3 extends forwardly, and the recording head flexible cable 21 extends backwardly with the conveyance path of the carriage 4 in between, thus making it possible to divide the ink supply path formed by the ink tube 3 and the electrical connection path formed by the recording head flexible cable 21 into the front and rear sides. Consequently, even if ink leakage should occur from the ink supply path on the way, there is little possibility that ink is in contact with the electrical connection path.

Further, the ink tank unit 2 that retains ink to be supplied can be arranged reasonably on the front side of the movement path of the carriage 4. On the other hand, the control board 18 having the main electric components thereon can be arranged reasonably on the rear side. In other words, the ink supply system is arranged on the front side of the movement path of the carriage 4, and the main electric components are arranged on the rear side thereof from the viewpoint of the apparatus as a whole. Structurally, therefore, even if ink leakage should take place in the ink supply system, ink can hardly be in contact with the main electric components.

Also, for the ink jet recording apparatus embodying the present invention, the main components, such as the conveying roller 8 that constitutes conveyance means, and the driving mechanism are arranged on the sheet feeding side, that is, those are arranged reasonably on the rear side of the apparatus. Then, the ink tube 3 is connected with the recording head 1 from the front side where a recording medium is expelled by conveyance means after recording. In other words, the ink supply system and the main driving mechanism of conveyance means are arranged on the front and rear sides with the movement path of the carriage 4 between them, that is, these are arranged apart from each other. Therefore, even if ink leakage should occur in the ink supply system, it is possible to prevent ink from being in contact with the driving mechanism of conveyance means, which may cause electrical malfunction.

The ink tube 3 and the recording head flexible cable 21 are connected with the moving carriage 4 or the recording head 1 mounted thereon. Therefore, in order not to impede the movement of the carriage 4, there is a room given to the length thereof from each connecting portion on the carriage 4 side to the fixing portion on the other end side. As a result, curving occurs at least in the movement of the carriage 4.

For the present embodiment, the ink tube 3 and the recording head flexible cable 21 are arranged to create one bending portion at all the time for each of them as shown in FIG. 4 and FIG. 5. Then, the bending portions are configured to enable the shape of one bending portion that presents the linearly symmetrical line in the moving path direction of the carriage 4 to be substantially the same as that of the other bending portion.

Consequently, the forces exerted and given to the carriage 4 by the restoring forces of the recording head flexible cable 21 and the ink tube 3 at the respective bending portions are generated in almost in the linearly symmetrical directions along the lines of the movement path of the carriage 4. Therefore, the components of both forces exerted in the direction orthogonal to the movement direction of the carriage 4 are directed to oppose each other, thus making them weaker by each other so as to minimize the force that may displace the carriage 4 in the direction orthogonal to the movement direction thereof. Also, the components of both forces in the direction parallel to the movement direction of the carriage 4 are in the same direction for both of them. Consequently, there is not exerted any force that may cause the carriage 4 to rotate. Such as this, the present embodiment makes it possible to avoid lowering the positional precision and the movement accuracy of the carriage 4 due to the forces exerted by the recording head flexible cable 21 and ink tube 3, thus performing the recording operation stably.

It is desirable to make the strength of force exerted by the recording head flexible cable 21 and ink tube 3 substantially equal in order to minimize the force given to the carriage 4 in the direction orthogonal to the movement direction thereof. For this purpose, the ink jet recording apparatus embodying the present invention makes the curvature radius of the bending portion of the recording head flexible cable 21 smaller that of the ink tube 3. In other words, in accordance with the present embodiment, the rigidity of the ink tube 3 is made higher than that of the recording head flexible cable 21. As a result, when both of them are bent in the same manner, the restoring force exerted by the ink tube 3 in the bending portion thereof is stronger. Therefore, the curvature radius of the bending portion of the ink tube 3 is made larger to enable the restoring force thereof in that portion weaker in order to keep balance with the restoring force of the recording head flexible cable 21.

In this case, it may be possible to provide a reinforcement member for either the recording head flexible cable 21 or the ink tube 3 to enhance of the rigidity thereof to keep balance of the strength of the restoring force. Also, when the recording head flexible cable 21 is formed by plural sheets of cables, there is a need for making the total strength of force given to the carriage 4 by each of them substantially equal to the force exerted by the ink tube 3. Like wise, if the ink tube 3 is formed by plural tubes, there is a need for making the total strength of force given to the carriage 4 by each of them substantially equal to the force exerted by the recording head flexible cable 21.

Also, as shown in FIG. 5, the ink jet recording apparatus embodying the present invention has a portion where the recording head flexible cable 21 extends along the wall of chassis 17 in a state of the carriage 4 being on the right-end standby position, and the ink tube 3 has a portion where it extends along the wall of the ink-tube supporting stand. Then, each of the bending portions occurs with those other than the portions extending along the walls. Thus, as the carriage 4 moves to the left, those extending along the walls become shorter, and the portions to be bent become longer. As a result, the curvature radius of the bending portion becomes greater. In other words, the bending portions of the recording head flexible cable 21 and ink tube 3 of the ink jet recording apparatus embodying the present invention are, as shown in FIG. 5, present the minimum curvature radius when the carriage 4 is on the right-end standby position.

As described above, the ink tube 3 and the recording head flexible cable 21 are pressed to the walls of the chassis 17 and the ink-tube supporting stand 57, respectively, by means of the restoring forces exerted in the bending portions, and kept there firmly by the friction forces thus generated. Also, the restoring forces exerted at the bending portions act upon in the direction of pulling the ink tube 3 and recording head flexible cable 21 from the respective fixing points on the walls. In this manner, each portion from the fixing point to the bending portion is kept stably in a state of being extended straightly. The smaller the curvature radius of the bending portion, the greater becomes this restoring force. Therefore, with the structure arranged to make the curvature radius smallest when the carriage 4 is on the standby position, the holding power is most effectively generated at that time to make it possible to suppress the hanging down of the ink tube 3 and recording head flexible cable 21 by its own weight. Also, the smaller the curvature radius of the bending portion, the more it becomes effective to suppress the flat type ink tube 3 and recoding head flexible cable 21 not to incline its widthwise direction from being horizontal to vertical, that is, to prevent them from being twisted.

As described above, the carriage 4 is held in a state of being conveyed to the standby position when recording operation is at rest. As a result, there is a case where it is held in such state for a long time. Also, when the carriage 4 is on the standby position, the ink jet recording apparatus embodying the present invention is capable of most effectively suppressing the hanging down of the recording head flexible cable 21 and ink tube 3 due to its own weight, thus effectively preventing any constant deformation from being generated by the hanging down that may take place as the time elapse and by being left intact in such a state of being hung down for a long time.

In this respect, the curvature radius of the bending portion becomes greater as the carriage moves to the left side as described above. At this juncture, the recording head flexible cable 21 and ink tube 3 are slightly tensioned to protrude toward the center of the movement path of the carriage 4 from the connecting part with the carriage 4 or with recording head 1. The ink jet recording apparatus embodying the present invention is structured so as not to allow the recording head flexible cable 21 and the ink tube 3 to be in contact with each other even in such a case. In other words, to constitute such structure, it is arranged to set the distance between the face where the connecting part on the carriage 4 side exists and the wall of the chassis 17 or the wall of the ink-tube supporting stand 57 that faces it, and the fixing position of the recording head flexible cable 21 or the ink tube 3 above such wall accordingly.

As described above, in accordance with the present embodiment, the cable and ink tube connected with the recording head held in the moving carriage are connected with the carriage or the recording head on the sides opposite to each other with the movement path of the carriage between them, thus making it possible to arranged the ink supply system and the main electric components on the sides opposite to each other with the movement path of the carriage between them. Therefore, even if ink leakage should take place, it is possible to prevent the electric components from being affected by the ink that may be in contact with the electric components.

Also, the cable and ink tube are arranged to configure the linearly symmetrical line of the bending portion created for one of them in the direction of the movement path of the carriage to be substantially the same as that of the other. As a result, the forces given to the carriage by the cable and ink tube are offset to make it possible to minimize the load given to the carriage. In this way, it becomes possible to operate the carriage stably to form high-quality images.

Also, with appropriate regulations given to the bending portions of the cable and ink tube, it becomes possible to suppress the hanging down of the cable and ink tube due its own weight, thus forming the structure to hold the cable and ink tube stably.

As described above, in accordance with the present embodiment, it is possible to provide a highly reliable recording apparatus capable of performing high-quality recording operation.

What is claimed is:

1. A recording apparatus for recording on a recording medium, said apparatus comprising:

conveying means for conveying the recording medium in a predetermined conveying direction;

a movable recording member;

a moving mechanism for moving said movable recording member along a moving route which crosses the conveying direction so that said movable recording member is opposed to the recording medium to perform recording thereon; and a plurality of flexible members, one end of each said flexible member being connected to a body of said recording apparatus and another end of each said flexible members being connected to said movable recording member, wherein at least one of said flexible members is connected to said movable recording member from upstream of the conveying direction and a remainder of said flexible members is connected to said movable recording member from downstream of the conveying direction.

2. A recording apparatus according to claim 1, wherein at least one of said flexible members is an electric cable.

3. A recording apparatus according to claim 1, wherein at least one of said flexible members is an ink tube.

4. A recording apparatus according to claim 1, wherein said movable recording member is a carriage for moving a recording head serially.

5. A recording apparatus according to claim 4, wherein at least one of said flexible members is an electric cable.

6. A recording apparatus according to claim 4, wherein at least one of said flexible members is an ink cable.

7. A recording apparatus according to claim 1, wherein said movable recording member is a recording head mounted on a carriage.

8. A recording apparatus according to claim 7, wherein at least one of said flexible members is an electric cable.

9. A recording apparatus according to claim 7, wherein at least one of said flexible members is an ink tube.

10. A recording apparatus according to claim 1, wherein said movable recording member is an ink tank mounted on a carriage.

11. A recording apparatus according to claim 10, wherein at least one of said flexible members is an electric cable.

12. A recording apparatus according to claim 10, wherein at least one of said flexible members is an ink tube.

13. A recording apparatus comprising:

a carriage mountable with a recording head for recording by depositing liquid on a recording medium;

a moving mechanism for reciprocally moving said carriage along a moving route;

a tube connected to said recording head from a direction across the moving route to supply the liquid to said recording head; and a cable connected to said recording head from a direction across the moving route and opposed to said tube to supply an electric signal to said recording head.

14. A recording apparatus according to claim 13, further comprising:

a liquid tank fixed to said recording apparatus for retaining said liquid to be supplied to said recording head; and a control unit for controlling and processing electric signals, wherein said liquid tank is arranged on the side having said tube connected with respect to the moving route of said carriage, and said control unit is arranged on the side having said cable connected with respect to the moving route of said carriage, and said tube is connected with said liquid tank, and said cable is connected with said control unit.

15. A recording apparatus according to claim 14, wherein said tube and said cable are flexible, and said tube and said cable are positioned in areas apart from each other along the horizontal plane even when flexing of said tube between a fixing point on said carriage side and a nearest fixing point on said liquid tank side and flexing of said cable between a fixing point on said carriage side and a nearest fixing point on said control unit side present a maximum curvature radiuses at least in the moving route of said carriage.

16. A recording apparatus according to claim 14, wherein said tube and said cable are flexible, and configuration of one of a flexure of said tube between a fixing point on said carriage side and a nearest fixing point on said liquid tank side and a flexure of said cable between a fixing point on said carriage side and a nearest fixing point on said control unit side presents substantially the same linearly symmetrical line in the moving route of said carriage as that of the other at least in the moving route of said carriage.

17. A recording apparatus according to claim 16, wherein a strength of a restoring force exerted on said flexure of said tube and that of a restoring force exerted on said flexure of said cable are substantially equal.

18. A recording apparatus according to claim 17, wherein a plurality of said cables is connected with said recording head, and a sum of restoring forces exerted on said flexures of said plurality of cables is substantially equal to the strength of a sum of restoring forces of said flexure of said tube.

19. A recording apparatus according to claim 17, wherein a plurality of said tubes is connected with said recording head, and a sum of restoring forces exerted on said flexures of said plurality of tubes is substantially equal to the strength of the sum of restoring forces of said flexure of said cable.

20. A recording apparatus according to claim 16, wherein depending on rigidity of said tube and said cable, a radius of curvature of the one having higher rigidity is larger than that of the one having lower rigidity.

21. A recording apparatus according to claim 16, wherein a reinforcement member for making the restoring force exerted on said flexure stronger is bonded to said tube or said cable.

22. A recording apparatus according to claim 16, wherein when a recording operation is at rest, said carriage moves to a standby position, and a radius of curvature of said flexure is made smallest.

23. A recording apparatus according to claim 22, wherein on both sides of said moving route of said carriage, each wall having a face opposed to said carriage extends along said moving route, and on each of said side faces, a fixing point of said tube and a fixing point of said cable are arranged, respectively, and said flexure is formed between the fixing point on said carriage side and the point on said side face of said wall opposed to said carriage.

24. A recording apparatus according to claim 22, wherein said tube is configured to be flat, and said tube is held between the fixing point on said carriage side and the fixing point on said liquid tank side with the widthwise direction thereof substantially in the vertical direction.

25. A recording apparatus according to claim 22, wherein said cable is configured to be flat, and said cable is held between the fixing point on said carriage side and the fixing point on said control board side with the widthwise direction thereof substantially in the vertical direction.

26. A recording apparatus according to claim 13, further comprising:

conveyance means for conveying said recording medium in the direction crossing with the moving route of said carriage through a recording area recordable by said recording head opposite to the moving route, wherein said tube is connected with said recording head from the side having said recording medium expelled after recording.

27. A recording apparatus according to claim 13, further comprising:

a panel portion provided with operational switches for inputting manual instructions or display portion for indicating status, wherein said tube is connected with said recording head from the side having said panel portion installed.

28. A recording apparatus according to claim 13, wherein said recording head is an ink jet recording head to discharge said liquid for the adhesion thereof to said recording medium.

29. A recording apparatus comprising:

recording means opposed to a recording medium and moving along a moving route to record on the recording medium;

a flexible tube connected to said recording means to supply ink to said recording means; and a flexible cable connected to said recording means to supply an electrical signal to said recording means, wherein said tube has a first curved portion and a restoring force of said first curved portion presses said recording means in a first direction across the moving route, and wherein said cable has a second curved portion and a restoring force of said second curved portion presses said recording means in a second direction opposed to said first direction and across the moving route.

30. A recording apparatus according to claim 29, wherein said tube is fixed to a tube fixing portion of a body side of said recording apparatus, and said first curved portion is formed between said recording means and said tube fixing portion.

31. A recording apparatus according to claim 29, wherein said cable is fixed to a cable fixing portion of a body side of said recording apparatus, and said second curved portion is formed between said recording means and said cable fixing portion.

32. A recoding apparatus according to claim 29, wherein said tube is pressed to a wall of a body side of said recording apparatus by the restoring force caused at the first curved portion.

33. A recording apparatus according to claim 29, wherein said cable is pressed to a chassis of a body side of said recording apparatus by the restoring force caused at the second curve portion.

* * * * *